US006401798B1

(12) United States Patent
Kondo

(10) Patent No.: US 6,401,798 B1
(45) Date of Patent: Jun. 11, 2002

(54) ROTATING DRUM FOR RECLAIMING MOLDING SAND AND MOLDING SAND RECLAIMING APPARATUS

(75) Inventor: Toshio Kondo, Kawasaki (JP)

(73) Assignee: Nippon Chuzo Kabushiki Kaisha, Kanagawa (JP)

( * ) Notice: Subject to any disclaimer, the term of this patent is extended or adjusted under 35 U.S.C. 154(b) by 0 days.

(21) Appl. No.: 09/456,654

(22) Filed: Dec. 8, 1999

(30) Foreign Application Priority Data

Dec. 11, 1998 (JP) ..... 10-352244

(51) Int. Cl.[7] ..... B02C 19/12

(52) U.S. Cl. ..... 164/412; 164/5; 241/91; 241/275; 241/DIG. 10

(58) Field of Search ..... 164/412, 5; 241/91, 241/275, DIG. 10

(56) References Cited

U.S. PATENT DOCUMENTS 4,436,138 A * 3/1984 Kondo ..... 164/5
5,706,879 A 1/1998 Renner et al. ..... 164/5

FOREIGN PATENT DOCUMENTS

EP 0053882 6/1982
GB 1535093 12/1978
JP 62240135 10/1987
JP 2521765 1/1989

OTHER PUBLICATIONS

Patent Abstracts of Japan of JP 08011135 Dated Jan. 16, 1996.
Patent Abstracts of Japan of JP 07116772 Dated May 9, 1995.
Patent Abstrac of Japan of JP 62240135 of Oct. 20, 1987.
English Abstract of JP2521765 of Jan. 1, 1989.

* cited by examiner

*Primary Examiner*—M. Alexandra Elve
*Assistant Examiner*—Len Tran
(74) *Attorney, Agent, or Firm*—Ladas & Parry

(57) ABSTRACT

A molding sand reclaiming apparatus comprising an agitation tank which is provided with a fluidized bed at the inner bottom thereof and also provided with a charging port for used sand and a discharging port for reclaimed sand on the side wall thereof, a rotating shaft driven by a driving source disposed in the agitation tank; a rotating drum which is driven by the rotating shaft to agitate used sand charged into the agitation tank and peel off extraneous matters on the used sand; a classification tank which communicates with the upper part of the agitation tank via a regulating plate and is provided with a dust collecting port; and an air pressure source to fluidize the used sand charged on the fluidized bed in the agitation tank and classify, in the classification tank, the used sand into two parts of the extraneous matters peeled off by the rotating drum and the reclaimed sand, wherein scattering holes for scattering the used sand are formed in a cylinder portion constituting outside of the rotating drum.

6 Claims, 9 Drawing Sheets

FIG・1

ROTATING DRUM FOR RECLAIMING MOLDING SAND AND MOLDING SAND RECLAIMING APPARATUS

BACKGROUND OF THE INVENTION

1. Field of the Invention

The present invention relates to a rotating drum for reclaiming molding sand and a molding sand reclaiming apparatus for reclaiming molding sand from used sand which has been used for a casting mold. More particularly, it relates to a rotating drum for reclaiming molding sand and a molding sand reclaiming apparatus, in which extraneous matters sticking on used sand are peeled off by a mutual frictional contact between a fixed layer of used sand formed on the inner peripheral surface of the rotating drum by centrifugal force and used sand thrown in so as to reclaim sand from the used sand.

2. Prior Art

FIG. 10 shows a conventional apparatus disclosed in Japanese Patent Publication No. 2521765. FIG. 10(*a*) is an explanatory view of the whole apparatus, and FIG. 10(*b*) is an enlarged view of partition plates.

In FIG. 10(*a*), reference numeral 101 denotes a hopper for throwing molding sand in, 102 denotes an extruding member, 103 denotes a rotating grindstone, 104 denotes an opening, 105 denotes a molding sand tank for recycling, 106 denotes a molding sand extrusion passage, 107 denotes a driving motor, 108 denotes a storage section used to discard impurities, 109 denotes a dust collector transfer pipe, 110 denotes a depressurizing/pressurizing conveying pipe, 111 denotes a blow-up fan, 112 denotes a transfer passage, 113 denotes a screen member, and 116 denotes a transversely acting cylinder. In FIG. 10(*b*), reference numeral 114 denotes a partition plate, and 115 denotes a hole. Reference character A denotes molding sand, and a and b denote upper and lower space portions of the molding sand tank 105 used for recycling, respectively.

In the molding sand reclaiming apparatus shown in FIG. 10, a mass of molding sand A thrown into the hopper 101 is extruded from the extrusion passage 106 by the extruding member 102, and is ground by the rotating grindstone 103. Iron chips and core bars mixed in the mass of molding sand A are stored automatically in the discard storage section 108, and only particulate molding sand is screened by the screen member 113 in the transfer passage 112 and is transferred to the base of the depressurizing/pressurizing conveying pipe 110. The molding sand transferred to this portion is pushed up by the function of the air flow generated by the blow-up fan 111 and a dust collector, and stacked on the partition plates 114 provided in the molding sand tank 105 for recycling.

When the stacked amount on the partition plates 114 reaches a predetermined amount, the extrusion of the extruding member 102 is stopped, and then the two partition plates 114 are moved transversely. The holes 115 in the partition plates 114 are aligned by this transverse movement, so that the molding sand A drops from the lower space portion b onto the rotating grindstone 103 through the opening 104. The molding sand A is ground again, and is stored in the molding sand tank 105. The same operation is repeated until a predetermined degree of grinding is attained. Finally, the molding sand A is taken out of the molding sand tank 105 by means of a transfer pipe 119, and reclaimed molding sand A is taken out of a reclaimed sand storage tank 118. Besides, a "molding sand reclaiming apparatus" disclosed in Japanese Patent Laid-Open No. 62-240135 is well known as an apparatus in which a plurality of rotating grindstones are provided in suspended molding sand.

As described above, the conventional molding sand reclaiming apparatus shown in FIG. 10 has an advantage that a series of processes to reclaim sand from the mass of molding sand A can be carried out continuously. However, such a configuration is used in this apparatus that the molding sand A extruded from the extrusion passage 106 is ground by the rotating grindstone 103. Therefore, the apparatus has a disadvantage that the rotating grindstone 103, which comes into contact with the molding sand and grinds it while being rotated, wears remarkably. In particular, in this conventional apparatus, a mass of molding sand A is extruded from the extrusion passage 106 by the extruding member 102 such as a cylinder mechanism, and is pushed compulsorily on the rotating grindstone 103, so that the outside diameter of the grindstone wears extremely.

If the outside diameter of the rotating grindstone 103 wears away, the radius of rotation of the rotating grindstone 103 for grinding decreases in accordance with proceeding of the wear, resulting in a decrease in the peripheral speed. Therefore, the grinding efficiency for reclaiming the molding sand decreases, resulting in the necessity of replacing the rotating grindstone 103. In order to replace the rotating grindstone 103, the operation of the molding sand reclaiming apparatus is stopped once, and then the apparatus is disassembled and the rotating grindstone 103 must be removed together with the driving shaft thereof. As a result, there arise problems in that the reclamation efficiency is decreased by troublesome replacing work of the rotating grindstone 103 and interruption of operation, and many spare rotating grindstones 103 for replacement must always be reserved according to the degree of wear. These problems also occur on the aforementioned "molding sand reclaiming apparatus" disclosed in Japanese Patent Laid-Open No. 62-240135.

The present invention has been made to solve the above problems with the conventional apparatuses, and accordingly, an object thereof is to provide a rotating drum for reclaiming molding sand and a molding sand reclaiming apparatus in which a consumptive element such as the aforementioned rotating grindstone 103 is unnecessary, a high reclaiming performance is provided to keep the recovery percentage of reclaimed sand high, and the power consumption for operating the apparatus is kept low to restrain excessive equipment cost etc.

SUMMARY OF THE INVENTION

The present invention provides a rotating drum for reclaiming molding sand comprising a drum consisting of both a disk portion having a rotating shaft on its axis and a cylinder portion whose inner peripheral face is connected to the periphery of the disk portion, and a plurality of scattering holes formed in the cylinder portion to scatter molding sand from the inside of the drum to the outside thereof in accordance with the rotation of the rotating shaft.

Also, the present invention provides a rotating drum for reclaiming molding sand, in which the periphery of the disk portion is connected to an end of the cylinder portion to form a drum having a substantially U-shaped cross section.

Also, the present invention provides a rotating drum for reclaiming molding sand, in which the periphery of the disk portion is connected to a substantially middle position of the cylinder portion to form a drum having a substantially I-shaped cross section.

Also, the present invention provides a molding sand reclaiming apparatus comprising an agitation tank which is provided with a fluidized bed at the inner bottom thereof and also provided with a charging port for used sand and a discharging port for reclaimed sand on the side wall thereof; a rotating shaft driven by a driving source and disposed in the agitation tank; a rotating drum which is driven by the rotating shaft to agitate used sand charged into the agitation tank and peel off extraneous matters on the used sand; a classification tank which communicates with the upper part of the agitation tank and is provided with a dust collecting port; and an air pressure source to fluidize the used sand charged on the fluidized bed in the agitation tank and classify, in the classification tank, the used sand into two parts of the extraneous matters peeled off by the rotating drum and the reclaimed sand, characterized in that scattering holes for scattering the used sand are formed in a cylinder portion constituting the outside of the rotating drum.

Further, the present invention provides a molding sand reclaiming apparatus comprising a vertical cylindrical housing body provided with a suction port for dust and a discharging port for reclaimed sand at the upper part and the lower part thereof, respectively; a funnel-shaped hopper which is provided coaxially at the upper end of the body to supply used sand; a distributor which is disposed under the hopper to receive the supplied used sand and to drop the used sand distributively in the circumferential direction; a rotating drum having a U-shaped cross section which is disposed coaxially under the distributor to receive the used sand distributively dropped in the drum; a rotation driving source for rotating a rotating shaft which is fixed to the rotating drum; an annular shelf which is disposed around the rotating drum with a gap to receive the used sand received in the drum and scattered in accordance with the rotation of the rotating drum; and an air stream source which sends an air stream from the lower side of the rotating drum to blow the used sand upward in the body, characterized in that scattering holes for scattering the used sand are formed in a cylinder portion constituting the outside of the rotating drum, and the annular shelf is constituted by a lower shelf and an upper shelf for receiving the used sand ejected from the scattering holes and the edge of the cylinder portion of the rotating drum, respectively.

BEST MODE FOR CARRYING OUT THE INVENTION

Embodiments of the present invention will now be described with reference to the accompanying drawings.

Embodiment 1

Figure 1:
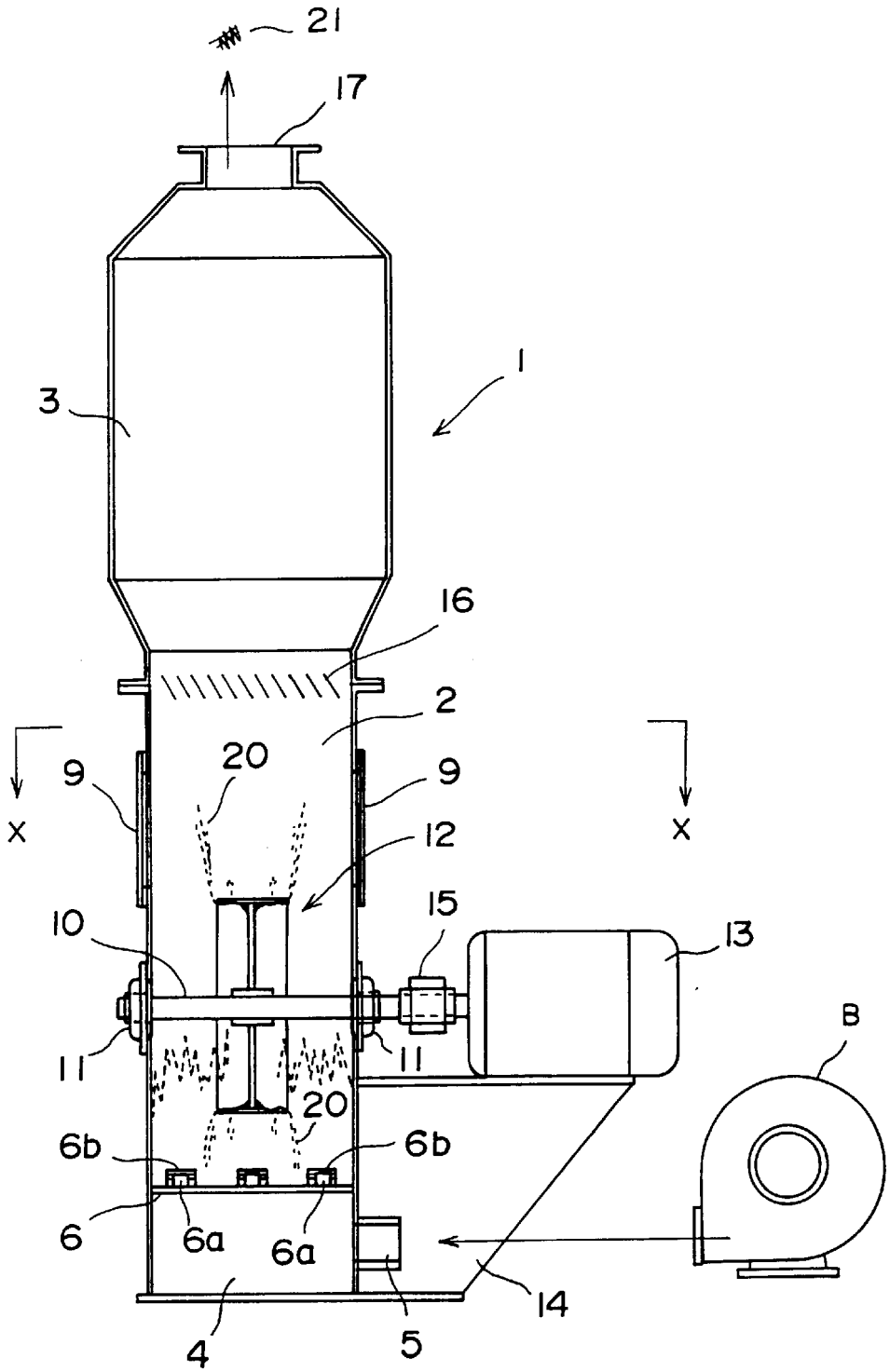
FIG. 1 is an explanatory view of a configuration of Embodiment 1 of the present invention.
Figure 2:
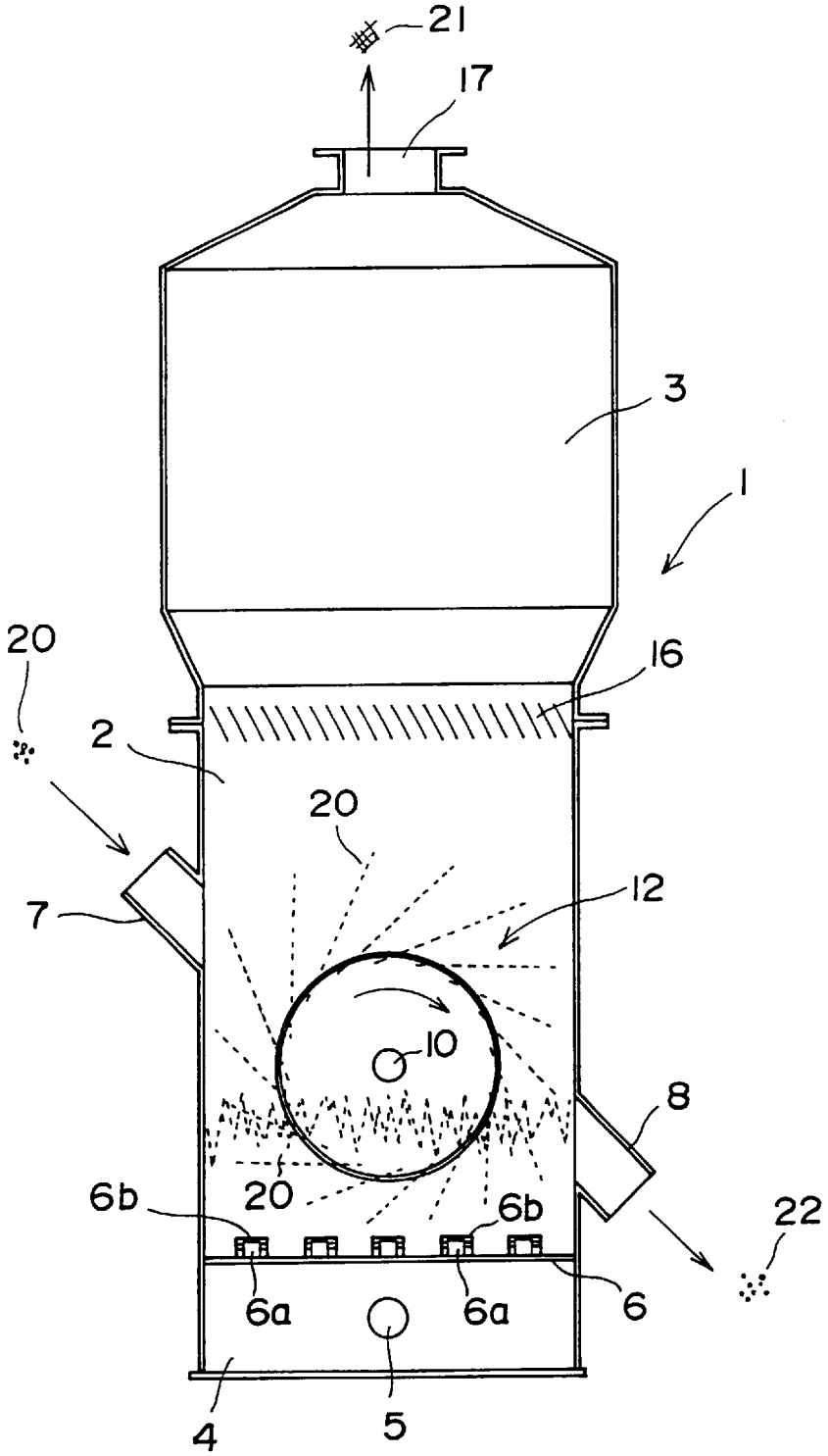
FIG. 2 is a side sectional view of FIG. 1.
Figure 3:
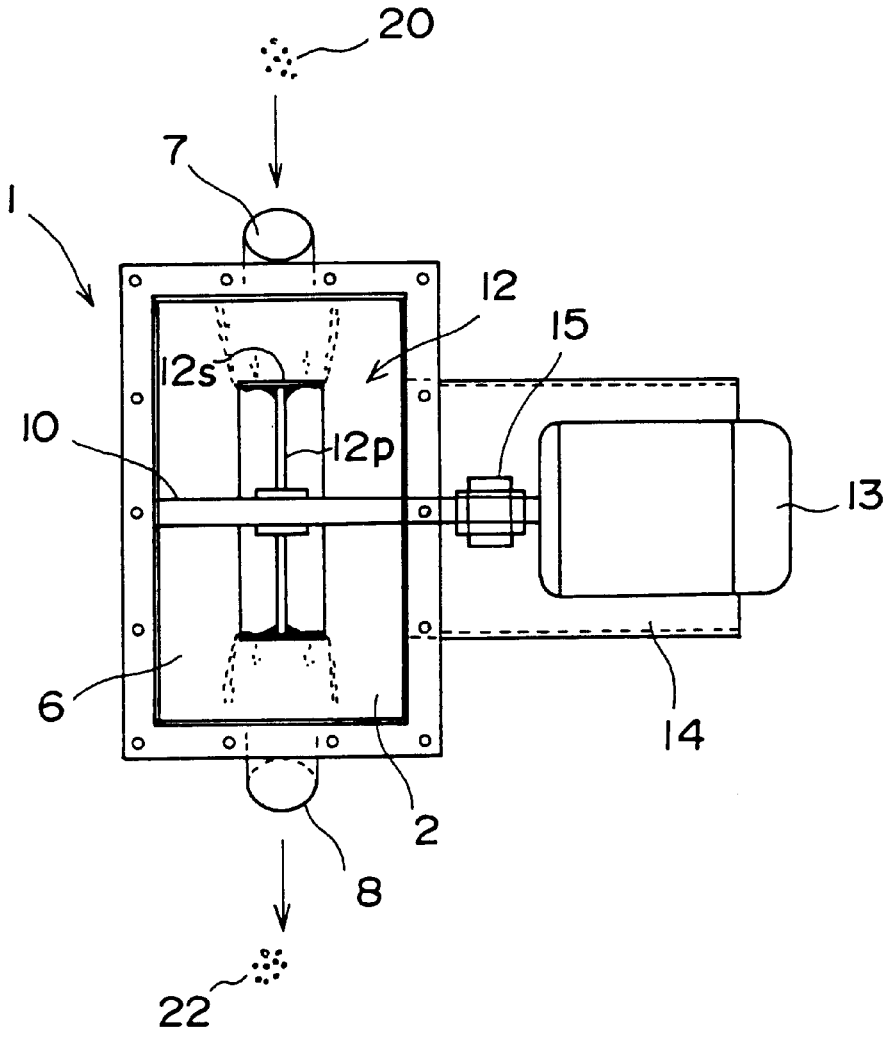
FIG. 3 is a sectional view taken along the line X—X of FIG. 1.
Figure 4:
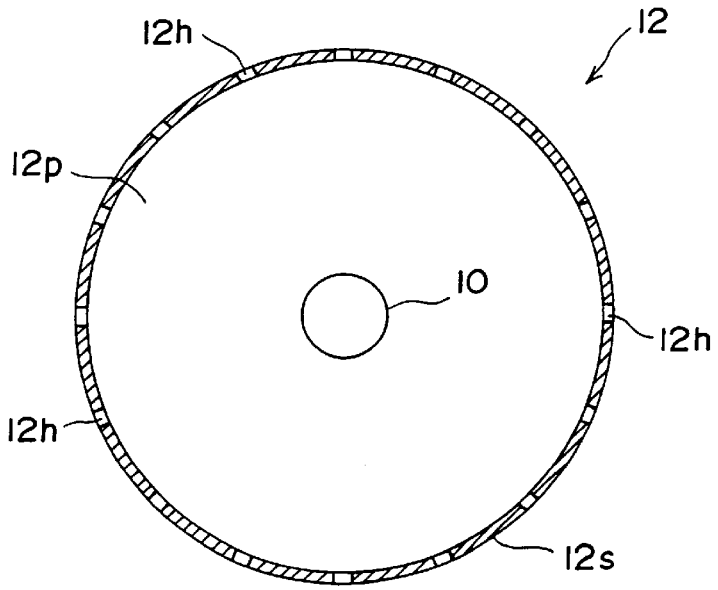
FIG. 4 is a sectional view of a rotating drum.

FIG. 1 is an explanatory view of a configuration of Embodiment 1 of the present invention, FIG. 2 is a side sectional view of FIG. 1, FIG. 3 is a sectional view taken along the line X—X of FIG. 1, and FIG. 4 is a sectional view of a rotating drum.

In FIGS. 1 to 3, reference numeral 1 denotes a housing body. The body 1 is in a square shape, and is constructed by two parts of a lower agitation tank 2 and an upper classification tank 3. Reference numeral 4 denotes an air blowing chamber formed at the bottom of the agitation tank 2, 5 denotes an air blowing port, and 6 denotes a fluidized bed. As shown in FIG. 2, the fluidized bed 6 is provided with many convex protrusions 6*b* having a plurality of ventilating ports 6a on the side face thereof.

Reference numerals 7 and 8 denote a charging tube and a discharging tube provided on opposite side walls of the agitation tank 2, and 9 denotes an observation port. Both of the charging tube 7 and the discharging tube 8 are installed obliquely to the side walls of the agitation tank 2, and although not shown in detail, the degrees of opening and the heights of a charging port and a discharging port provided on the same faces as the side walls can be adjusted by manual operation. Reference numeral 10 denotes a driving shaft, and 11 denotes right and left bearings. The bearings 11 are installed to the side walls of the agitation tank 2 to hold the driving shaft 10 horizontally at an intermediate height.

Reference numeral 12 denotes a rotating drum. The rotating drum 12 is constructed by welding steel materials, for example, and consists of a disk portion 12*p* and a cylinder portion 12*s*. The driving shaft 10 is fixed to the disk portion 12*p* at the center of rotation, and a substantially middle position of the inner peripheral face of the cylinder portion 12*s* is connected to the peripheral edge of the disk portion 12*p*, so that the drum 12 having a substantially I-shaped cross section is formed. Particularly in the present invention, the cylinder portion 12*s* is provided with a plurality of scattering holes 12*h* penetrating in the radial direction. In Embodiment 1, sixteen scattering holes 12*h* with a diameter of 10 mm arranged in a row are formed at equal angular intervals on the circumference of the cylinder portion 12*s* with a diameter of 300 mm on each of opposite sides of the disk portion 12*p* (see FIG. 4).

Reference numeral 13 denotes an electric motor, 14 denotes a mounting bed, and 15 denotes a joint. The electric motor 13 is fixed on the mounting bed 14, and the output shaft thereof is connected to the driving shaft 10 via the joint 15. Reference numeral 16 denotes a regulating plate, and 17 denotes an exhaust port. The regulating plate 16 is so provided between the agitation tank 2 and the classification tank 3 that the classification tank 3 communicates with the agitation tank 2. Although not shown in the figure, the exhaust port 17 is connected to a dust collector provided on the outside. Reference numeral 20 denotes used sand, 21 denotes extraneous matters described above, and 22 denotes reclaimed sand that is obtained by removing the extraneous matters 21 from the used sand 20. Reference character B in FIG. 1 denotes a blower. The regulating plate 16 changes the direction of the used sand 20 scattered from the rotating drum 12 to prevent the used sand 20 from going directly into the exhaust port 17.

The following is a description of the operation of Embodiment 1 of the present invention, which is configured as described above.

In advance, a mold is broken by a breaker, and the used sand 20 is accumulated in a hopper with aid of a belt conveyor. A supplying passage communicating with the charging tube 7 of the used sand 20 is formed from the hopper. Also, the output passage of the blower B shown in FIG. 1 is connected to the air blowing port 5 of the air blowing chamber 4. Further, based on the broken condition, material, and the like of the used sand 20 in the hopper, the quantity of air supplied from the blower B to the air blowing chamber 4 and the operation time are set at values suitable for peeling off the extraneous matters 21.

The charging tube 7 provided on the side wall of the agitation tank 2 is opened, and a predetermined amount of used sand 20 is charged into the agitation tank 2. A lower peripheral portion of the rotating drum 12 fixed to the driving shaft 10 is buried in the used sand 20 by the charging of the used sand 20. Then, the electric motor 13 is energized by turning on a power source switch, so that the driving shaft 10 is driven via the joint 15. The rotating drum 12, a part of which is buried in the used sand 20, begins to be rotated, for example, at 1500 to 3000 rpm by the drive of the driving shaft 10.

On the other hand, air from the blower B is supplied to the air blowing chamber 4 through the air blowing port 5, and an air stream with a high air pressure is ejected into the agitation tank 2 through the ventilating ports 6*a* of the convex protrusions 6*b* on the fluidized bed 6. The pressurized air ejected through the ventilating ports 6*a* pushes up the used sand 20, which is charged into the agitation tank 2 and accumulated on the fluidized bed 6, in the multidimensional direction to make it flow. The used sand 20, which flows in a nondirectional manner in the vicinity of the rotating drum 12, enters an inside space of the rotating drum 12 that is rotating at a high speed. A centrifugal force of the rotating drum 12 is applied to the used sand 20 having entered the inside of the rotating drum 12.

Most of the used sand 20 subjected to the centrifugal force is scattered from the opening of the rotating drum 12 to the outer periphery in the agitation tank 2, dropped on the fluidized bed 6, and then allowed to flow again. Also, some of the used sand 20 previously entering the rotating drum 12 is accumulated at corners between the cylinder portion 12*s* and the disk portion 12*p* by the centrifugal force to form fixed layers of sand grains. In this case, since the cylinder portion 12*s* is formed with scattering holes 12*h* in the radial direction, the used sand 20 accumulated at the corners passes through the scattering holes 12*h* and is scattered in the circumferential direction. As a result, annular fixed layers S blackened portions are formed having many cone-shaped concave portions s formed around the scattering holes 12*h* along the corners of the rotating drum 12.

Figure 5:
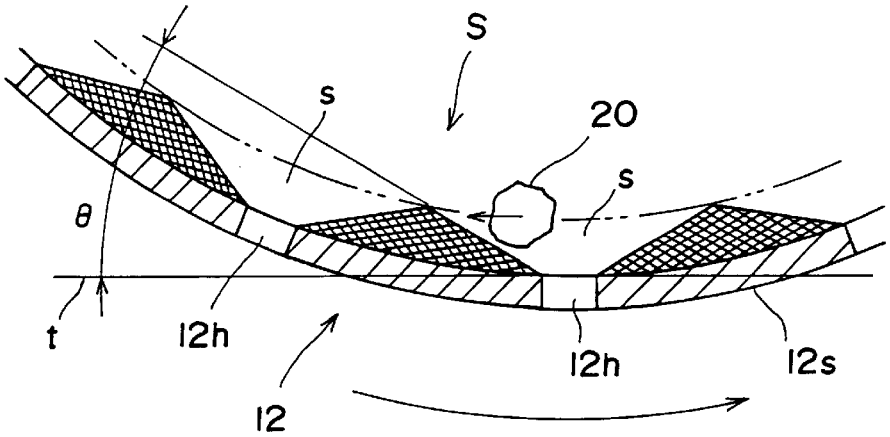
FIG. 5 is an explanatory view showing the operation of Embodiment 1.

FIG. 5 is an enlarged sectional view, taken in the direction perpendicular to the axis, of a fixed layer S of sand grains with concave portions s. As shown in the figure, in the cross-sectional shape of a concave portion s, inclined faces with an angle θ (referred to as a contact angle) to a tangential line t at a scattering hole 12*h* is formed on both sides. The used sand 20 (shown in an enlargement), which enters the rotating drum 12 rotating at a high speed while being fluidized in a nondirectional manner on the fluidized bed 6 in the agitation tank 2, comes into frictional contact with the inclined faces with the contact angle θ of the concave portions s formed in large numbers in the fixed layer S while colliding with the inclined faces one after another. As a result, the extraneous matters 21 sticking on the outside face of the used sand 20 are peeled off effectively by the inclined faces with the angle θ of the concave portions s. The two-dot chain line in FIG. 5 indicates an inner layer surface of a fixed layer in a drum which is provided with no scattering holes 12*h*, where the contact angle θ is 0.

Subsequently, based on the above-described cooperative operation between the fixed layer S in the rotating drum 12 rotating at a high speed and the fluidized used sand 20, the operation for peeling off the extraneous matters 21 proceeds continuously in the agitation tank 2. As the peeling-off operation proceeds, the extraneous matters 21 separated from the used sand 20 pass through the regulating plate 16 and are pushed up into the classification tank 3 by means of the ejecting air stream passing between the fluidized grains of the used sand 20 in the agitation tank 2. Coarse grains in the used sand 20 pushed up by the ejecting air stream are turned and dropped by the gravity, and are returned to the agitation tank 2 via the regulating plate 16. On the other hand, the light extraneous matters 21 sent into the classification tank 3 are collected in a dust collector, not shown, through the exhaust port in succession.

Normally, the reclaiming treatment is performed by continuous operation. The quality of the treated sand is determined by residence time T. Taking a residence amount of fluidized layer as W (kg), and a charging amount as V (kg/h), the residence time T can be determined by the following equation.

$$T=(W/V)\times 60(\text{min})$$

The charging amount V of the used sand 20 determined by inverse operation from the necessary residence time T is charged continuously from the charging port. Since the residence amount W is determined automatically by the height of the discharging port, the amount corresponding to the charging amount V is discharged automatically.

Also, in the case of batch treatment, the discharging port is made capable of being opened/closed freely. When the treatment has been performed for a predetermined time after charging a certain amount, the discharging port is opened to discharge the whole amount. For rapid discharge, the position of the discharging port is set low. During this time, the blower B for blowing air and the electric motor 13 for rotating the rotating drum 12 are rotated continuously.

Figure 6:
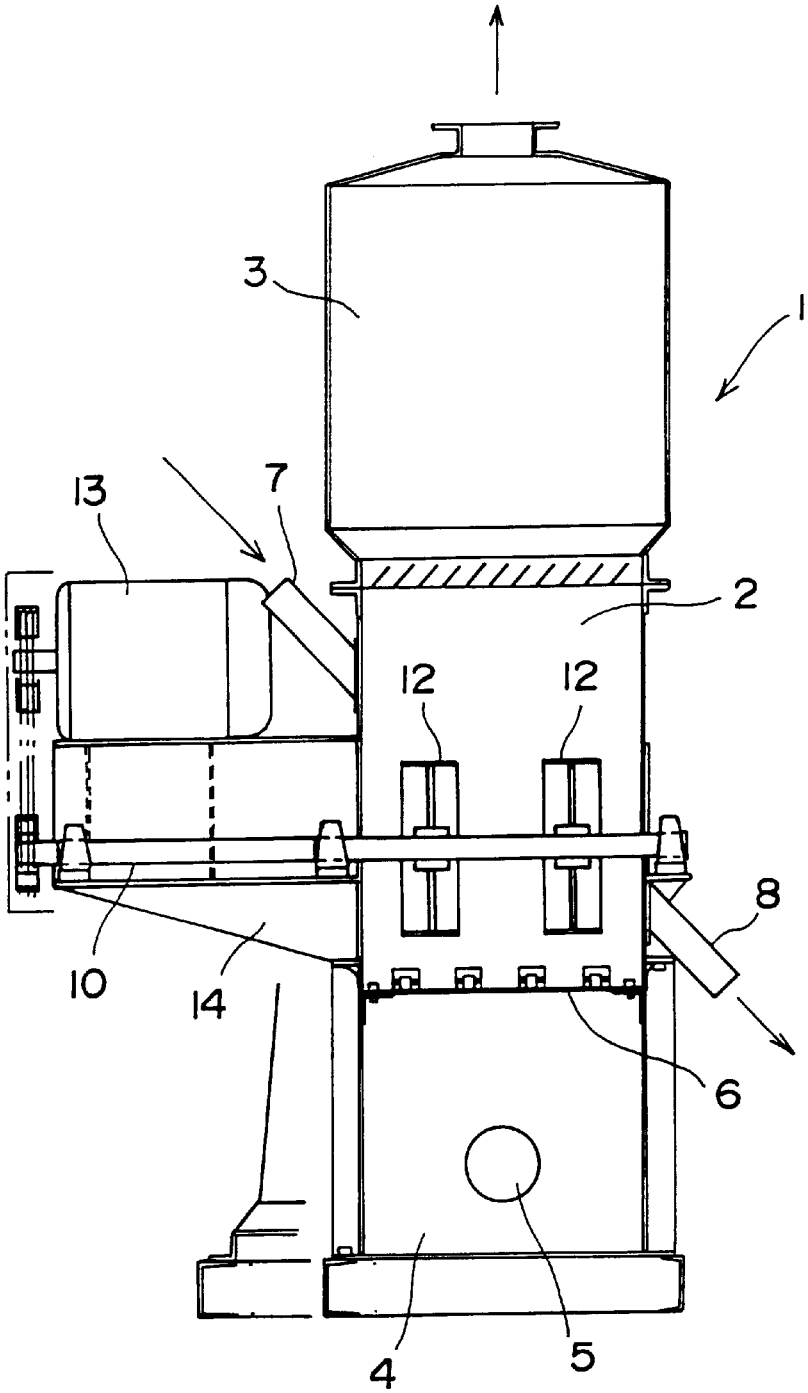
FIG. 6 is an explanatory view of a modification of Embodiment 1.

FIG. 6 is an explanatory view of a modification of Embodiment 1.

In this modification, the width of the housing body 1 is increased slightly, two rotating drums 12 are fixed to the driving shaft 10 in parallel, and an electric motor 13 with a high rating is used. The content volumes of the agitation tank 2 and the classification tank 3 are increased so as to increase the residence amount and enhance reclamation efficiency by increasing the treatment amount of the used sand 20. Although not shown in detail, a rotating drum 12 used in the modification shown in FIG. 6 is also provided with a plurality of scattering holes 12*h* in the radial direction in the cylinder portion 12*s*. Although the two rotating drums 12 are the same in FIG. 6, the outside diameter, width, or material of the drum 12 or the hole diameter of the scattering holes 12*h* may be configured selectively. Although the illustration of sectional view etc. and the description are omitted, the reclaiming operation of the used sand 20 is performed effectively in this case as well as in the above-described case shown in FIGS. 1 to 5.

Embodiment 2

Figure 7:
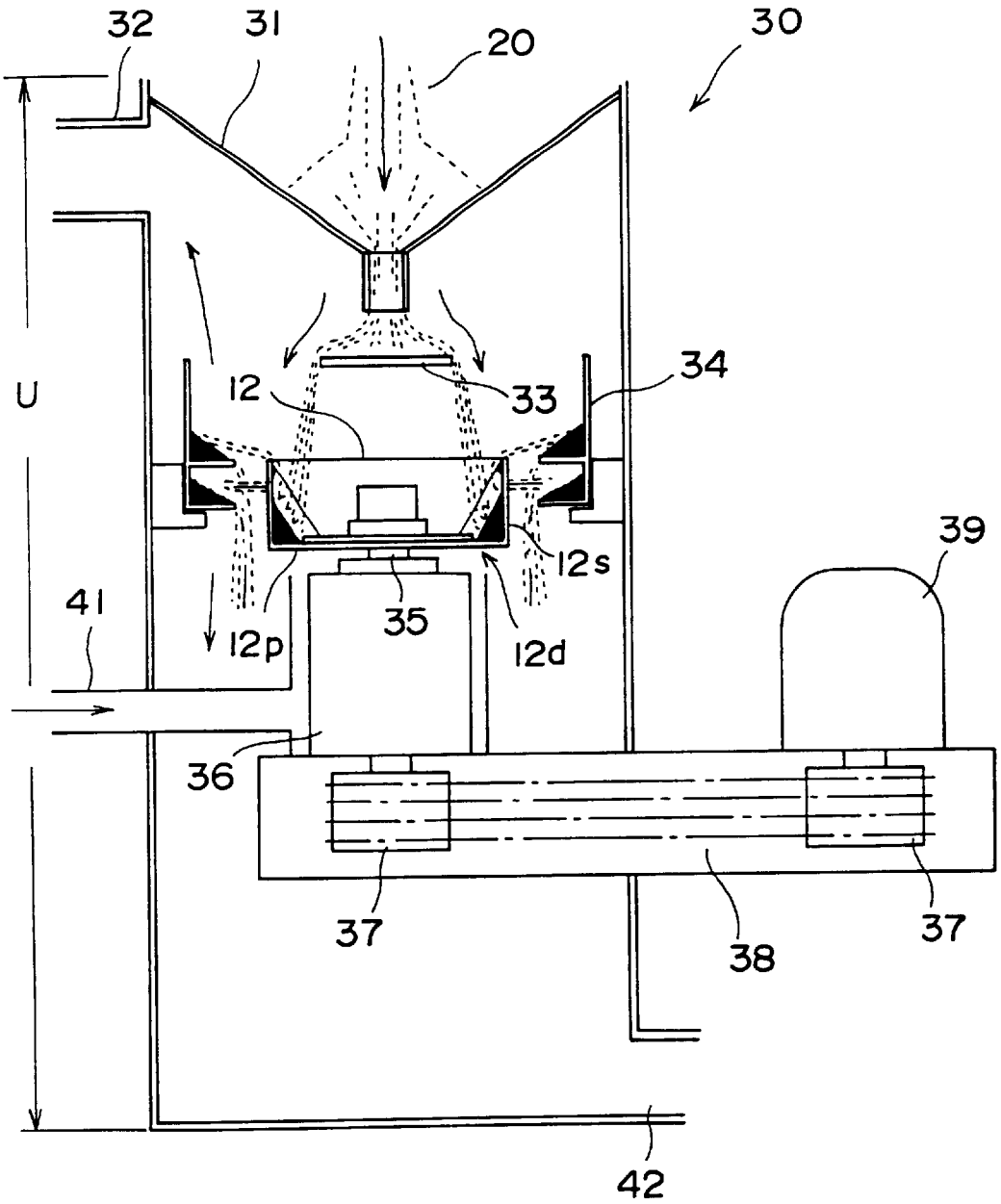
FIG. 7 is an explanatory view of a configuration of Embodiment 2 of the present invention.

FIG. 7 is an explanatory view of a configuration of Embodiment 2 of the present invention.

In FIG. 7 showing Embodiment 2, reference numeral 30 denotes a housing body consisting of a cylinder, 31 denotes a hopper formed in a funnel shape on the upper face of the body 30, 32 denotes a dust suction port, and 33 denotes a distributor. The distributor 33 is formed in a disk shape, and is installed under the hopper 31. Reference numeral 12 denotes a rotating drum which is the same as the rotating drum already described in Embodiment 1.

In Embodiment 2, the rotating drum 12 is so configured that the disk portion 12*p* is connected to one end of the cylinder portion 12*s* to form the drum 12 with a U-shaped cross section, and is so arranged that its opening faces upward. In this case as well, the cylinder portion 12*s* is provided with a plurality of scattering holes 12*h* formed at equal intervals on the circumference in the direction perpendicular to the axis. Reference numeral 34 denotes an annular shelf formed by stacking two tiers of shelves having an L-shaped cross section. The annular shelf 34 is fixed to the body 30 around the rotating drum 12 with a gap formed on the outside of the rotating drum 12. The upper and lower shelves of the annular shelf 34 are arranged at positions corresponding to the tip end of the peripheral wall of the cylinder portion 12*s* and the scattering holes 12*h* of the rotating drum 12 respectively.

Reference numeral 35 denotes a driving shaft which is arranged vertically and to which the rotating drum 12 is fixed, and 36 denotes a bearing for the shaft. Also, reference numeral 37 denotes two pulleys, 38 denotes a belt set around the outer peripheries of the two pulleys 37, 39 denotes an electric motor, 41 denotes an air blowing tube, and 42 denotes a discharging port. The air blowing tube 41 is connected to a blower, and the supplied pressurized air is sent in the arrow marked direction, so that an air stream directing from the lower part of the rotating drum 12 to the upper part thereof is created. The housing body 30 forms a unit U in one unit ranging from the hopper 31 to the discharging port 42 of reclaimed sand 22. If necessary, a multi-stage unit nU may be configured by stacking several units.

The following is a description of the operation of Embodiment 2 shown in FIG. 7.

The used sand 20 supplied from the hopper 31 onto the distributor 33 is distributed uniformly in the circumferential direction, and drops continuously in a cylindrical shape onto the rotating drum 12 arranged coaxially. On the other hand, when the electric motor 39 is driven, the rotating drum 12 begins to rotate at a high speed via the belt 38 set around the pulleys 37 and the driving shaft 35. As described above, the used sand 20 that drops from the distributor 33 while drawing a circular shape collides one after another with inclined faces with a contact angle θ of many concave portions s formed in a fixed layer S rotating at a high speed together with the rotating drum 12.

The colliding used sand 20 comes into frictional contact with the inclined faces, so that the extraneous matters 21 are peeled off effectively. After the extraneous matters 21 are peeled off, some of the used sand 20 passes through the scattering holes 12*h*, and the remaining used sand 20 goes over the peripheral wall of the rotating drum 12, so that both of the used sand 20 are ejected in the circumferential direction. Both of the used sand 20 ejected from the scattering holes 12*h* and the peripheral wall separately collide again respectively with separate fixed layers S1 and S2 of the used sand 20 previously accumulated at the corners of the lower and upper shelves of the annular shelf 34.

Collision of the used sand 20 with the sand layers accumulated on the annular shelf 34 causes the extraneous matters to be peeled off again and the sand overflows and drops from the annular shelf 34 one after another. The used sand 20 dropping from the annular shelf 34 is blown in the radial direction by a jet stream supplied from the air blowing tube 41. As a result, the reclaimed sand 22 is separated from fine particles by the jet stream, and is discharged through the discharging port 42 after passing through a middle stage portion in the body 30. The separated fine particles are caused to fly up by the jet stream, and is sucked and discharged through the dust suction port 32.

Thus, according to the reclaiming apparatus of Embodiment 2, the operation of removing the extraneous matters from the used sand 20 is performed at two stages on the rotating drum 12 and the annular shelf 34. In particular, since the inclined faces with the contact angle θ are formed on the fixed layer S of the rotating drum 12, a strong grinding operation is performed between the colliding used sand 20 and the fixed layer S. Moreover, the used sand 20 subjected to this grinding operation flows separately into two directions of the upper and lower tiers of the annular shelf 34 so as to collide with the two fixed layers S1 and S2. As a result, the treatment time for reclaiming sand from the used sand 20 can be shortened remarkably. Also, since the contact, collision, etc. between sand grains or between the sand grains and the sand layer are utilized, a consumptive element such as a grindstone used in the above-described conventional apparatus is unnecessary, so that the equipment cost can be kept very low.

Next, the results of experiments using the embodiments of the present invention will be explained with reference to FIGS. 8 and 9.

Figure 8:
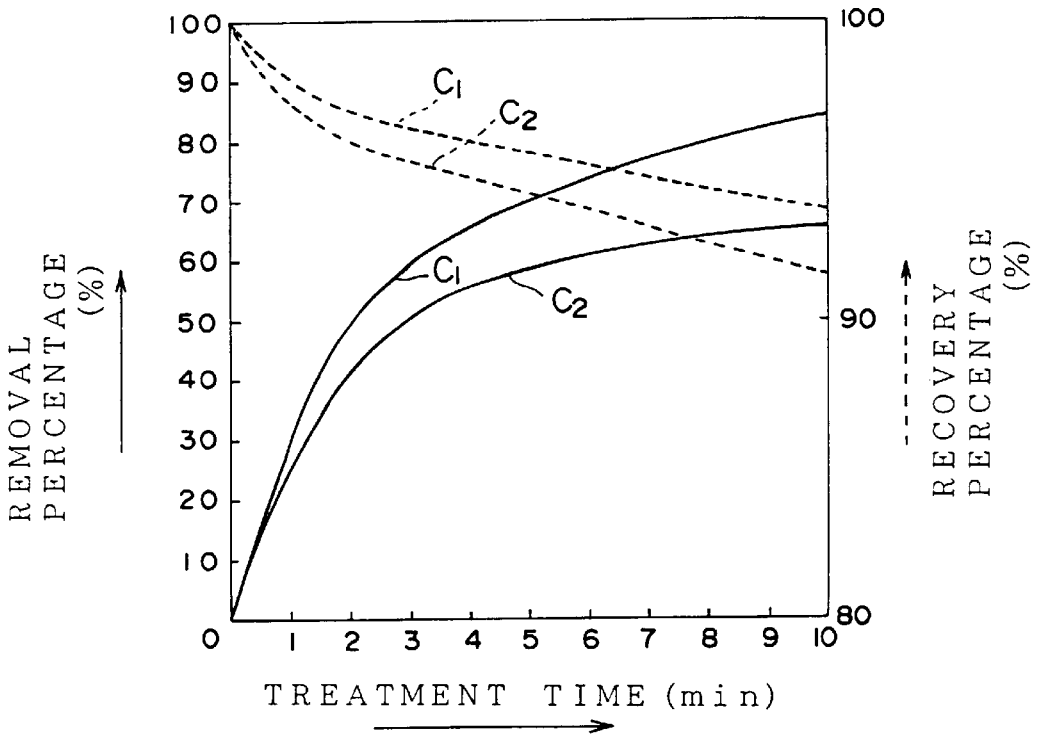
FIG. 8 is a characteristic diagram showing recovery percentage and removal percentage.

FIG. 8 is a diagram showing the characteristics of the removal percentage of the extraneous matters 21 and the recovery percentage of the reclaimed sand obtained in the apparatus of the present invention and the reference apparatus. The ordinates represent the removal percentage and the recovery percentage (% for both of these) and the abscissas the treatment time (minute). Characters C1 and C2 denote the change curves with respect to the treatment time of the apparatus of the present invention and the reference apparatus. For example, at a treatment time of 3 minutes, the removal percentage of the apparatus of the present invention is 60%, while that of the reference apparatus is about 50%. Also, the recovery percentages of the apparatuses at this time are 97% and 95%, respectively. These results show excellent performance of molding sand reclaiming operation of the present invention. The reference apparatus compared with the apparatus of the present invention is a reclaiming apparatus using a vertical type rotating drum as shown in FIG. 7 but not provided with the scattering holes.

Figure 9:
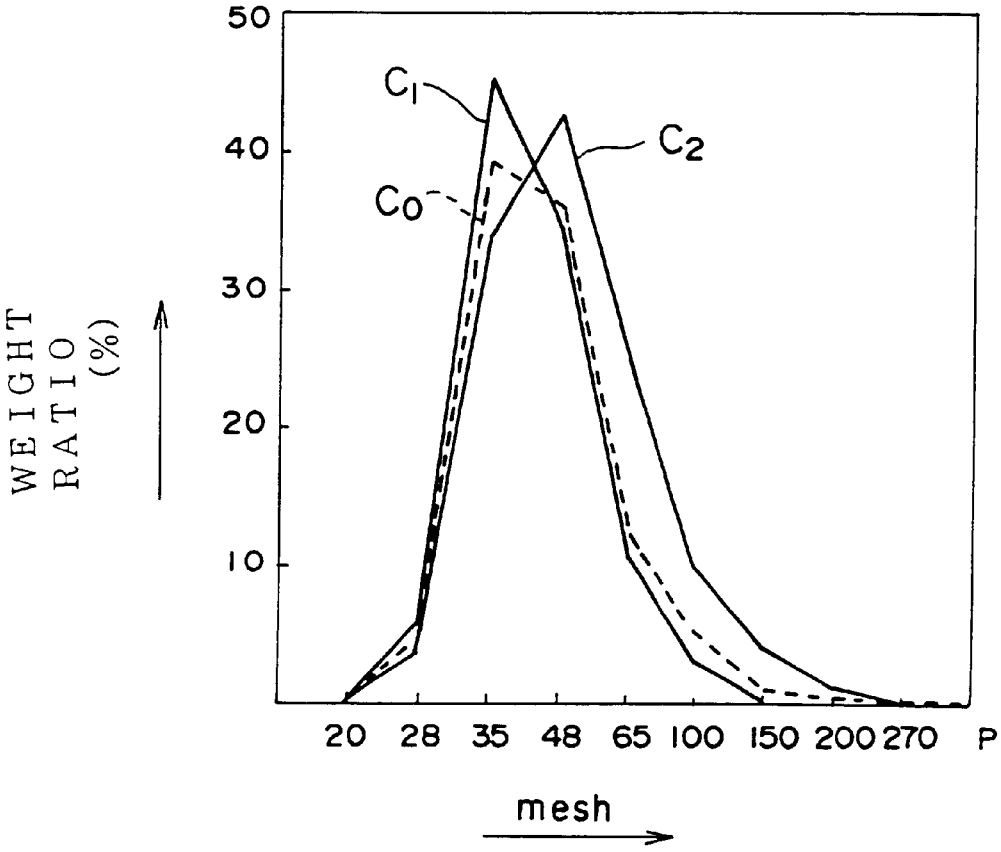
FIG. 9 is a distribution diagram showing grain size of used sand and reclaimed sand.
Figure 10:
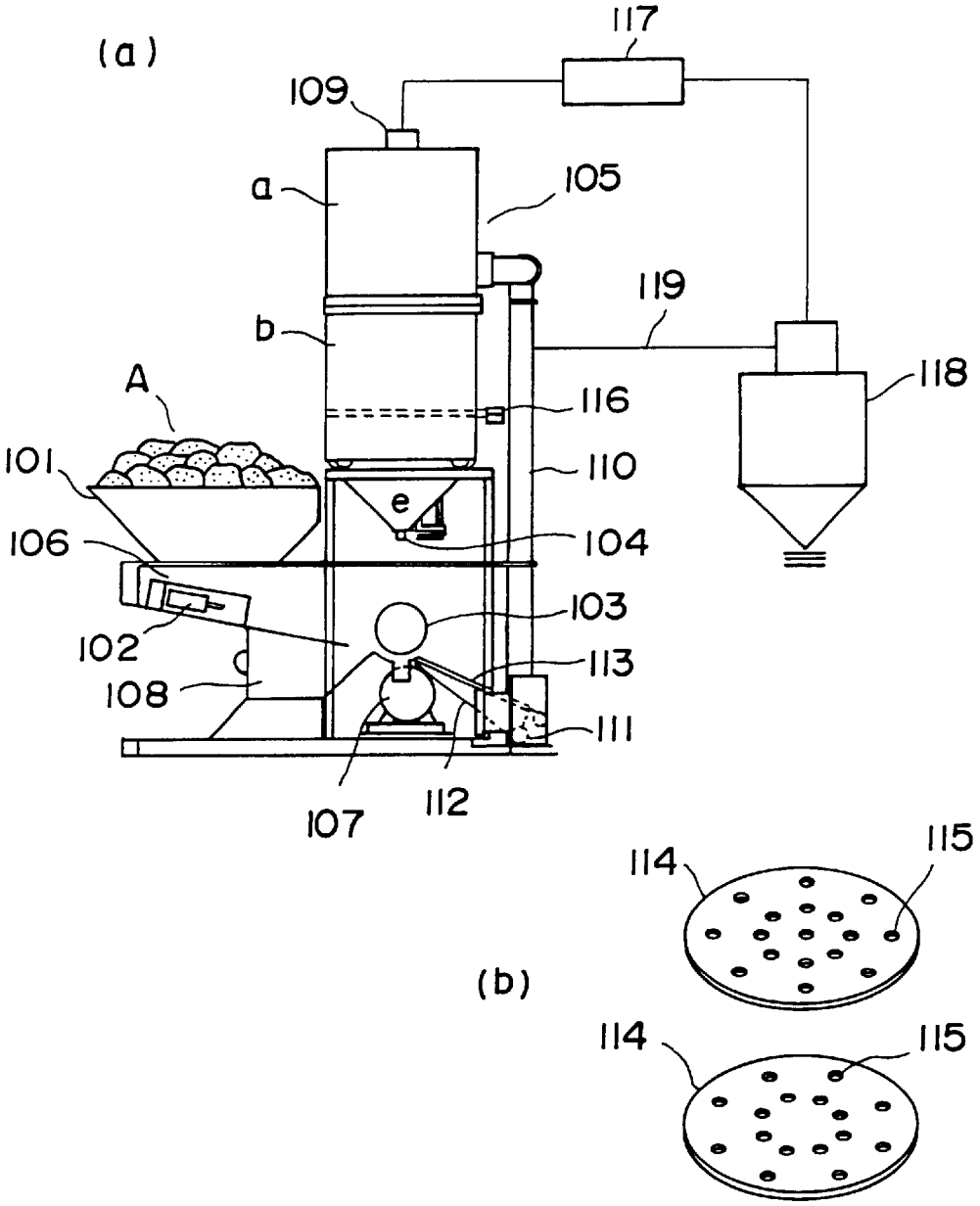
FIG. 10 is an explanatory view of a configuration of a conventional molding sand reclaiming apparatus.

FIG. 9 is a grain size distribution diagram of sand grains when alkali phenolic sand is used. The broken line C0 indicates the grain size distribution of the used sand 20, and the solid lines C1 and C2 are polygonal lines indicating the grain size distribution of sand reclaimed in the apparatus of the present invention and the aforementioned reference apparatus respectively. In the solid line C2 indicating the characteristics of the reclaimed sand 22 of the reference apparatus, the peak point of the grain size distribution shifts in the direction of increasing mesh h to show finer grain size, being involved in the peeling-off operation of the extraneous matters. Contrarily, in the solid line C1 indicating the grain size characteristics of the reclaimed sand according to the present invention, the grain size is kept essentially the same as that of the broken line C0 indicating the characteristics of the used sand 20 because breakage of the sand involved in the peeling-off operation of the extraneous matters hardly occurs.

The experimental conditions of the present invention in FIG. 9 are as follows:

| | |
|---|---|
| Molding sand | Alkali phenol |
| Rotational speed | 2400 rpm |
| Drum diameter | 300 mm |
| Drum width | 100 mm |
| Number of drums | 1 |
| Number of scattering holes | 32 |
| Treatment amount | 35 kg (per batch) |

In addition, according to the results of the experiments and investigation conducted by the inventor, it was verified that the quality of the reclaimed sand 22 obtained by treating the used sand 20 for a treatment time of 3 minutes in the apparatus of the present invention configured as shown in FIG. 3 is equivalent to the quality of the reclaimed sand 22 obtained in the aforementioned reference apparatus configured by three units 3U. The configurations of both of the apparatuses in this case are given in Table 1. The "stage" in the reference apparatus means the number of stages n in the case where the unit U in FIG. 7 is configured in a multi-stage mode. Also, the "classification" means an additionally provided air dust collector. According to Table 1, there is a difference in treatment capacity between the apparatus of the present invention and the reference apparatus. However, comparing the power in the second column by conversion, the apparatus of the present invention requires only about 77% of the power consumption of the reference apparatus resulting in a lower power consumption. Therefore, the apparatus of the present invention has an economical advantage to keep the running cost low.

TABLE 1

| | Apparatus of present invention Treatment for 3 min | Comparison apparatus 3 stages + classification |
|---|---|---|
| Treatment capacity | 500 kg/hr | 5000 kg/hr |
| Power | 7.4 Kw | 96.2 Kw |
| Kg/Kw·hr | 67.5 | 52 |
| Kw·hr/ton | 14.8 | 19.24 |
| Consumption ratio | 77 | 100 |

Although the case where sixteen scattering holes 12*h* with a diameter of 10 mm arranged in a row are formed in the circumference of the cylinder portion with a diameter of 300 mm on each of opposite sides of the disk portion has been explained in the above-described Embodiment 1 of the present invention, the number of rows, the number of holes in a row, and the hole diameter are not limited to this embodiment. Also, although the case where steel is used for the rotating drum has been explained in the embodiments, a ceramic material with a low wear rate may be used. Further, the diameter of the scattering hole 12*h*, which is generally 5 to 15 mm, can usually be selected appropriately according to the grain size of molding sand to be reclaimed.

According to the present invention, extraneous matters on the used sand are removed and the sand is reclaimed by the direct grinding action between the used sand forming a fixed layer according to the rotation of the rotating drum and the fluidized sand flowing into the rotating drum, by the colliding friction between the used sand and the fluidized sand scattered by the centrifugal force of the rotating drum, and by the mutual frictional contact of the used sand fluidized in the fluidized layer. Therefore, there is no need for enhancing the frictional force by increasing the rotational speed of the rotating shaft, so that not only the used sand is hardly broken but also an electric motor with a low rating can be used. As a result, the recovery amount of reclaimed sand increases relatively to the equipment cost and power consumption, so that a good yield is assured improving the reclamation efficiency.

Thus, the present invention can provide a rotating drum for reclaiming molding sand and a molding sand reclaiming apparatus in which a consumptive element such as a grindstone is unnecessary, a high reclaiming performance is provided to keep the recovery percentage of reclaimed sand high, the power consumption for operating the apparatus is kept low and excessive equipment cost, etc. is restrained.

I claim:

1. A molding sand reclaiming apparatus comprising:

an agitation tank including a bottom provided with a plurality of ventilating ports and side walls provided with a charging port for used sand and a discharging port for reclaimed sand;

a rotatable shaft disposed horizontally in said agitation tank for being driven by a driving force for rotation about a horizontal axis;

a rotatable drum comprising a disk portion coaxially fixed to said rotatable shaft for rotation therewith about said horizontal axis and a cylindrical portion having an inner peripheral face connected to an outer periphery of said disk portion; said cylindrical portion of the rotatable drum extending horizontally beyond said disk portion to provide an open end of said cylindrical portion, a classification tank which communicates with an upper part of said agitation tank and is provided with a dust collecting port; and an air pressure source for supplying compressed air to said plurality of ventilating ports to fluidize the used sand charged in said agitation tank and classify in said classification tank, extraneous matter peeled off from the used sand by the action of said rotatable drum, and produce the reclaimed sand, said rotatable drum being immersed in said fluidized used sand, which enters the drum through said open ends thereof, to provide an accumulation layer of said used sand on said peripheral surface of said cylindrical portion of said drum which acts to produce friction with the fluidized used sand entering the drum and cause separation of said extraneous matter from the used sand.

2. A molding sand reclaiming apparatus according to claim 1, wherein a plurality of scattering holes are provided in said cylindrical portion of the rotatable drum to scatter the used sand from inside the drum to outside the drum when the drum is rotated by said rotatable shaft.

3. A molding sand reclaiming apparatus according to claim 2, wherein said charging port is located at a level in said agitation tank above the discharging port.

4. A molding sand reclaiming apparatus according to claim 3, wherein said discharging port is located at a level of the fluidized used sand.

5. A molding sand reclaiming apparatus according to claim 4, wherein said charging and discharging ports are inclined with respect to a vertical axis of said agitation tank.

6. A molding sand reclaiming apparatus according to claim 1, wherein said cylindrical portion of said drum extends beyond said disk portion on opposite sides thereof to provide opposite open ends for said cylindrical portion on the opposite sides of the disk portion.

* * * * *